United States Patent [19]

Minty, Jr.

[11] 4,067,577

[45] Jan. 10, 1978

[54] APPARATUS FOR GAMES

[76] Inventor: George J. Minty, Jr., Bloomington, Ind.

[21] Appl. No.: 712,869

[22] Filed: Aug. 9, 1976

[51] Int. Cl.[2] ..... A63F 3/00

[52] U.S. Cl. ..... 273/275 GA

[58] Field of Search ..... 273/130 R, 130 B, 130 F

[56] References Cited

U.S. PATENT DOCUMENTS

| | | | |
|---|---|---|---|
| 2,571,195 | 10/1951 | Buck | 273/130 R |
| 2,726,087 | 12/1955 | Dunham | 273/130 R |
| 3,024,026 | 3/1962 | Goetz | 273/130 F |

FOREIGN PATENT DOCUMENTS

| | | | |
|---|---|---|---|
| 1,147,051 | 6/1957 | France | 273/130 F |

*Primary Examiner*—Richard C. Pinkham
*Assistant Examiner*—Arthur S. Rose
*Attorney, Agent, or Firm*—Jenkins, Coffey & Hyland

[57] ABSTRACT

An apparatus for use in playing a game includes a game board comprising first and second arrays of points. Both arrays are two-dimensional. The first array includes $n$ points in a first direction and $(n + 1)$ points in a second direction, respectively, where $n$ is an integer. The second array includes $(n + 1)$ points in the first direction and $n$ points in the second direction. The two arrays are arranged interjacent one another, and the points of the first array are distinguishable from the points of the second array. The apparatus further includes a plurality of game playing pieces, each of which has two pairs of points defining a quadrilateral array. The points of each pair are located generally across the quadrilateral array from one another. Each piece further includes first and second direction indicators. The first direction indicator indicates a direction between the points of the first pair and the second direction indicator indicates a direction between the points of the second pair. The first direction indicator is identifiable with the points of the first array on the game board. The second direction indicator is identifiable with the points of the second array on the game board.

7 Claims, 5 Drawing Figures

APPARATUS FOR GAMES

This invention relates to an apparatus which is useful for playing a number of games.

There are several known board games of a structural nature currently on the market. An example of games of this type is the BRIDGE-IT game. The game boards for such games typically include a rectangular array of points. Two opposite sides of the array are designated as belonging to one of the players. The remaining two opposite sides belong to the remaining player. Each player is supplied a number of playing pieces. Each game piece includes a segment of a path so that placement of pieces results in construction of a path. A player places one of his playing pieces on the board to his advantage. Then, the other player places a piece on the board to his advantage, although not in the position already occupied by the first player's piece. The game progresses in this fashion with each player placing game pieces on the board in positions not already occupied. The winner of the game is the first player who establishes a path across the array between his two sides thereof.

It is an object of the present invention to provide a novel variation on games of the type previously described.

According to the invention, the game apparatus includes a game board comprising first and second arrays of points. Each array is two-dimensional. The first array includes $n$ points in a first direction and $(n + 1)$ points in a second direction, respectively, where $n$ is an integer. The second array includes $(n + 1)$ points in the first direction and $n$ points in the same direction, respectively. The points of the first array are distinguishable from the points of the second array.

The game apparatus also includes a plurality of playing pieces, each of which comprises a quadrilateral array of four points. The points are divided into two pairs, with the points of each being positioned diagonally across the quadrilateral array. A first direction indicator extends between the points of the first pair and a second direction indicator extends between the points of the second pair. The first direction indicator is identifiable with the points of the first array on the game board. The second direction indicator is identifiable with the points of the second array on the game board.

In the preferred embodiment, the arrays of the game board and on the game pieces are rectangular. The two arrays on the game board are interpositioned so that, excluding points at the perimeter of the interpositioned arrays, a point on the first array is equidistant from its four nearest neighbor points on the second array and a point on the second array is equidistant from its four nearest neighbor points on the first array.

The invention may best be understood by referring to the following description and accompanying drawings which illustrate the invention. In the drawings.

Figure 1:
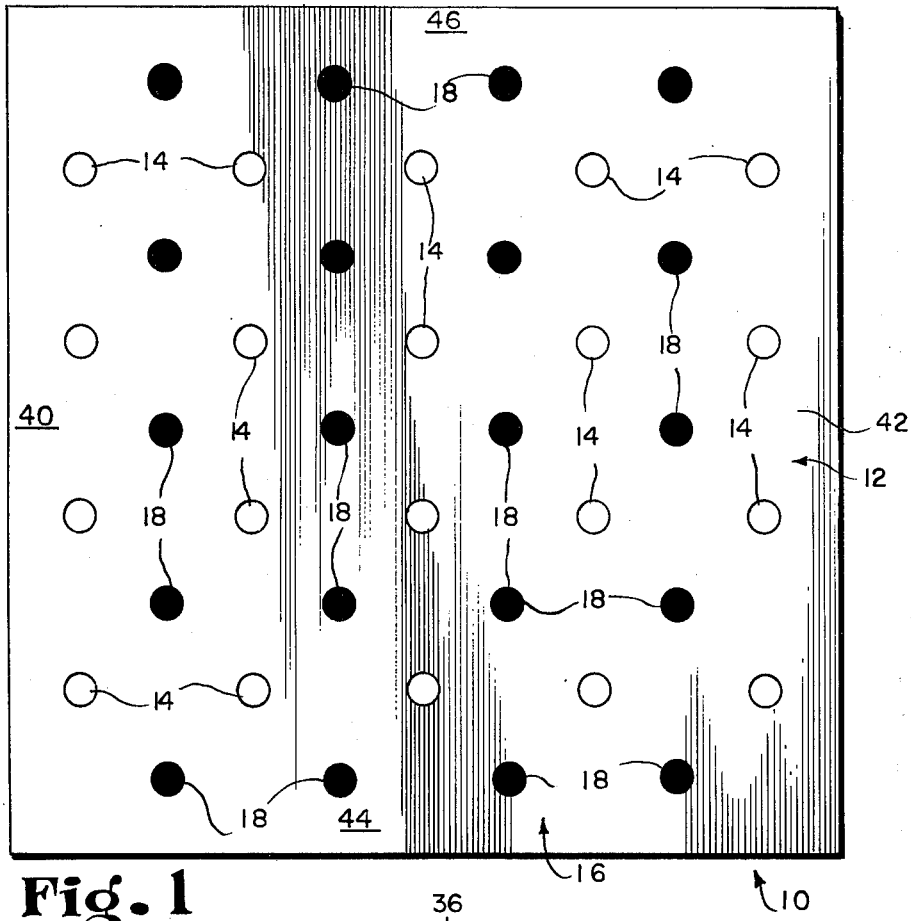
FIG. 1 is a top plan view of a game board constructed in accordance with the present invention.

Referring now to FIG. 1, an arrangement for the game board of the present invention is illustrated. The game board 10 comprises a first array 12 of points 14, and a second array 16 of points 18. The points 14 of array 12 are identifiable with one another and are distinguishable from points 18 of array 16. Points 18 are also identifiable with one another. For purposes of illustration, points 14 are indicated by circles and points 18 are indicated by dots. The points 14, 18 of the first and second arrays 12, 16, respectively, are interpositioned. That is, excluding points 14, 18 around the perimeter of the interpositioned arrays, each point 14 on first array 12 is equidistant from the four nearest neighbor points 18 on the second array 16. Further, each point 18 on second array 16 is equidistant from its four nearest neighbor points 14 on the first array 12.

Each of arrays 12, 16 is two-dimensional. In a first direction, toward the top of FIG. 1, array 12 includes four points 14. In a second direction, from left to right in FIG. 1, array 12 includes five points 14. In the first direction, array 16 includes five points 18. In the second direction, array 16 includes four points 18. It must be understood that the game board 10 can include any number of points 14, 18, as long as this interrelationship between the dimensions of arrays 12, 16 is met. That is, if the first array 12 has dimensions $n$ by $(n + 1)$ in first and second directions, respectively, second array 16 has dimensions $(n + 1)$ by $n$ in the first and second directions, respectively, where $n$ is an integer.

Figure 2:
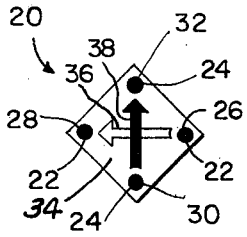
FIG. 2 is a top plan view of a game piece constructed in accordance with the present invention.

Referring now to FIG. 2, a game piece 20 comprises first and second pairs 22, 24, respectively, of points. Points 26, 28 of the first pair 22 and points 30, 32 of second pair 24 define a quadrilateral array on game piece 20. In the illustrated embodiment, points 26, 28, 30 and 32 are all identified by dots on the top surface 34 of game piece 20. The dots 26, 28 of pair 22 are positioned diagonally across the quadrilateral from one another. Dots 30, 32 of pair 24 are positioned diagonally across the quadrilateral from one another. A first direction indicator 36 extends between points 26, 28 and indicates the direction toward point 28. A second direction indicator 38 extends between points 30, 32 and indicates the direction toward point 32. Direction indictor 36 is identifiable with points 14 of array 12. For example, direction indicator 36 and points 14 may be of the same color. Direction indicator 38 is identifiable with points 18 of array 16. It should be understood that it is not necessary to the apparatus or to play the games hereinafter described that the points 26–32 be marked at all, it being understood that the points are adjacent the extremes of direction indictors 36, 38.

Figure 3:
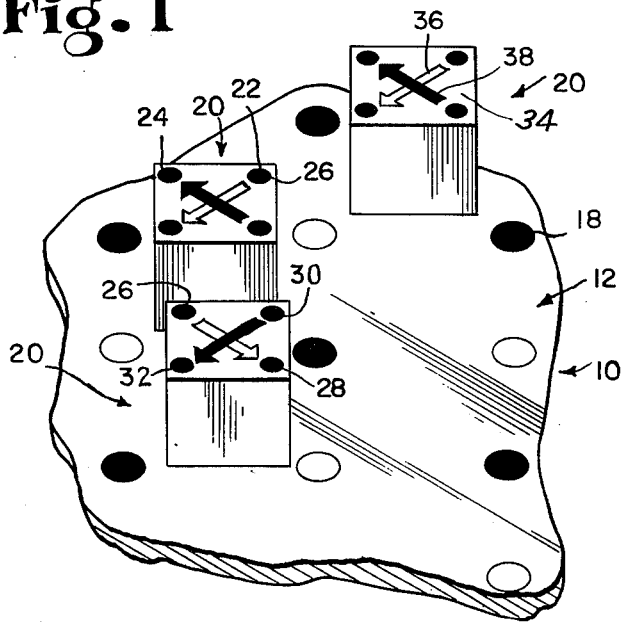
FIG. 3 is a perspective view of a fragment of the game board of FIG. 1 with a possible arrangement of a plurality of game pieces constructed in accordance with FIG. 2.

A game which is playable with the apparatus of the present invention may be understood with reference to FIGS. 1, 3. One side 40 of the game board 10 is designated as a first player's "start" side. An opposite side 42 is designated as the first player's "finish" side. A side 44 of the board is designated as a second player's "start" side. The remaining side 46 is designated as the second player's "finish" side. Each of the players is provided with several game pieces 20. All of the game pieces for both players are identical. The object of the game, for each player, is to construct a path across the game board 10 from his own "start" side to his own "finish" side before his opponent can do so. Such a path is constructed by placing a plurality of game pieces 20 advantageously on the board with the four points 26–32 on each game piece aligned with four adjacent points 14, 14, 18, 18 on the interpositioned arrays 12, 16. The two players' paths are represented by the first and second direction indicators 36, 38, respectively. The direction in which either player can trace any path so constructed is determined by direction indicators 36, 38.

The orientations of the pieces 20 on game board 10, and the resulting path segments can best be appreciated by referring to FIG. 3. The first player places one of his game pieces 20 randomly on the board. The piece need not necessarily be at or near his "start" side. The piece is placed to the advantage of the first player. The piece is placed on the board such that the array of points 26–32 defining the quadrilateral on the piece aligns with four points 14, 14, 18, 18 of the first and second arrays 12, 16, respectively, on board 10. Thus, as the first player places his first game piece, he defines a path segment in a particular direction for himself, i.e., from his "start" side 40 toward his "finish" side 42, as well as a path segment in a particular direction, i.e., from the "finish" side 46 toward the "start" side 44, for his opponent.

Then the second player places a piece 20 on the board in the same manner. The piece is placed to the second player's advantage (and to his opponent's disadvantage). The second piece cannot be placed in a position already occupied by the first player's piece. The players proceed in turn to place game pieces 20 on the board until one or the other has constructed a path from his "start" side to his "finish" side, all of the path segments of which point in the direction from his "start" side to his "finish" side. It will be appreciated that each time a player positions one of the illustrated game pieces 20 on board 10, he blocks a possible path for his opponent as well as constructing a portion of a path for himself.

With described game proceeding in this manner, one or the other of the players wins. There can be no drawn contests. Further, if either of the players constructs a winning path, but fails to recognize that he has done so, his failure to claim his victory will not be detrimental to him, since his opponent cannot possibly construct a winning path. Additionally, if the game should proceed until all available spaces on the game board 10 are filled by game pieces 20, one or the other of the players will win.

Figure 4A:
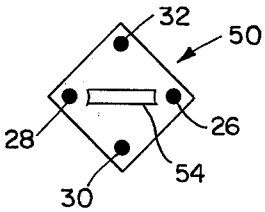
FIGS. 4*a–b* are top plan views of game pieces for use in playing variations of a game hereinafter described.
Figure 4B:
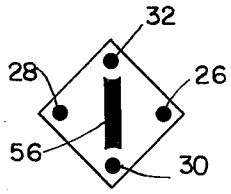

Other games can be played with game board 10, game pieces 20, and some additional apparatus. For example, the players can agree at the beginning of the game that the first player will be equipped with a small number, e.g., two, of additional game pieces 50 illustrated in FIG. 4*a* and the second player will be equipped with an equal number of additional game pieces 52 illustrated in FIG. 4*b*. Pieces 50, 52 include quadrilateral arrays of points 26–32 just as game piece 20. The points are divided into two pairs 22, 24. Pieces 50, 52 do not include direction indicators, however. Rather, pieces 50, 52 contain path segments 54, 56, respectively. Segment 54 extends between points 26, 28 of pair 22. Segment 56 extends between points 30, 32 of pair 24. A player uses the segments 54, 56 just as he uses his directional segments 36 or 38 to construct a path. However, a player can trace a path in either direction along path segment 54 or 56 to get from his "start" side of the board 10 to his "finish" side thereof.

What is claimed is:

1. Apparatus for a game comprising a game board having a first array of points, the first array having dimensions $n$ by $(n + 1)$ in first and second directions, respectively, where $n$ is an integer, and a second array of points distinguishable from the first points, the second array having dimensions $(n + 1)$ in the first and second directions, respectively, the points of the second array being interpositioned with the points of the first, and a plurality of game pieces, each piece including a first pair of points and a first direction indicator, the first direction indicator indicating a direction between the points of the first pair and being identifiable with the points of the first array, a second pair of points, and a second direction indicator indicating a direction between the points of the second pair and being identifiable with the points of the second array.

2. The apparatus of claim 1 wherein the first and second directions are perpendicular to one another.

3. Apparatus according to claim 2 wherein a point of the first array on the game board is equidistant from its four nearest neighbor points of the second array and a point of the second array on the game board is equidistant from its four nearest neighbor points of the first array.

4. The apparatus of claim 1 wherein the two pairs of points on each game piece define a quadrilateral array with the points of each pair positioned diagonally across the quadrilateral array.

5. The apparatus of claim 4 wherein the first direction indicator extends generally parallel to a line extending between the points of the first pair, the second direction indicator extending generally parallel to a line extending between the points of the second pair.

6. Apparatus according to claim 4 wherein the quadrilateral array is square, the two pairs of points defining the corners of the square.

7. Apparatus for a game including a game board comprising first and second arrays of points, both arrays extending in first and second directions, the first array having dimensions $n$ by $(n + 1)$ in the first and second directions, respectively, and the second array having dimensions $(n + 1)$ by $n$ in the first and second directions, respectively, where $n$ is an integer and the first and second directions are perpendicular to one another, the points of the second array interjacent the points of the first, and the points of the first array being distinguishable from the points of the second array, and a plurality of game pieces comprising first and second pairs of points defining a quadrilateral array, the points of each pair being located generally diagonally across the array from one another, and first and second direction indicators, the first direction indicator indicating a direction generally parallel to a line extending between the points of the first pair and the second direction indicator indicating a direction generally parallel to a line extending between the points of the second pair, the first direction indicator being identifiable with the points of the first array on the game board and the second direction indicator being identifiable with the points of the second array on the game board.

* * * * *

UNITED STATES PATENT OFFICE

CERTIFICATE OF CORRECTION

Patent No. 4,067,577 Dated January 10, 1978

Inventor(s) Gec ge J. Minty, Jr.

It is certified that error appears in the above-identified patent and that said Letters Patent are hereby corrected as shown below:

Column 1, line 34, change "same" to --second--.

Column 2, line 45, delete "of";

line 66, change "26-32 on" to --26-32 of--.

Column 3, line 34, after "With", insert --the--.

Column 4, line 7 (Claim 1), after "(n + 1)", insert --by n--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*